US005762710A

United States Patent [19]

Ngai et al.

[11] Patent Number: 5,762,710

[45] Date of Patent: Jun. 9, 1998

[54] APPARATUS FOR PROVIDING INSTANT IMPREGNATED WIPES

[75] Inventors: Mou Chung Ngai, Boxmeer; Gerrit J. Looman, Cuijk, both of Netherlands

[73] Assignee: Polymer Group, Inc., North Charleston, S.C.

[21] Appl. No.: 911,553

[22] Filed: Aug. 14, 1997

Related U.S. Application Data

[63] Continuation of Ser. No. 430,222, Apr. 28, 1995, abandoned.

[30] Foreign Application Priority Data

May 4, 1994 [GB] United Kingdom ..... 9408783

[51] Int. Cl.[6] ..... B05B 7/00; A47F 1/00

[52] U.S. Cl. ..... 118/300; 221/96

[58] Field of Search ..... 118/688, 692, 118/676, 679, 300, 325, 324, 500; 221/90

[56] References Cited

U.S. PATENT DOCUMENTS

| | | | |
|---|---|---|---|
| 3,318,725 | 5/1967 | Bryan | 118/324 |
| 3,460,513 | 8/1969 | Hesselmann et al. | 118/325 |
| 3,804,061 | 4/1974 | Cassar et al. | 118/325 |
| 4,667,846 | 5/1987 | Marceau | 221/96 |

FOREIGN PATENT DOCUMENTS 2173522 4/1985 United Kingdom .

*Primary Examiner*—Peter Chin
*Assistant Examiner*—Calvin Padgett
*Attorney, Agent, or Firm*—Juettner Pyle Piontek & Underwood

[57] ABSTRACT

An instant impregnated wipe system includes a housing 3 in which a drawer 1, containing a stack of wipes 2, is slidably mounted. The uppermost wipe in the drawer 1 is sprayed with material as the drawer closes. The spray 4 terminates when the drawer 1 is closed. An impregnated wipe can then be removed after opening the drawer 1.

10 Claims, 7 Drawing Sheets

APPARATUS FOR PROVIDING INSTANT IMPREGNATED WIPES

This application is a continuation of application Ser. No. 08/430.222 filed Apr. 28, 1995 now abandoned.

This invention relates to an apparatus which is capable of providing wipes which are impregnated with a material (such as a solvent). A preferred embodiment of the invention is particularly useful in sequentially providing, on demand, wipes which are impregnated with, for example, a liquid, such as water, solvent, solution of an active substance in water or solvent, or the like. Impregnated wipes have various uses, for example, they can be employed in the automotive industry, or have a medical, surgical or consumer use.

Solvent-impregnated fabric wipes are widely used for various purposes. Conventionally, such wipes are wetted with solvent just before use, either by soaking the wipe in the solvent and then allowing the wipe to drip dry, or by manually impregnating the wipe with solvent from a safety solvent can. Neither method is ideal for consistently impregnating wipes with a controlled amount of solvent.

The soaking method generally applies too much solvent to the wipe, and the manual pumping method tends to give an uneven distribution of solvent on the wipe.

A more recent method of delivering a solvent wet wipe is by pre-impregnating a coreless roll of wipes with solvent, and providing the coreless roll in a special container allowing removal of individual impregnated wipes. However, the container required for such a system is relatively expensive, because it needs to be specially adapted in view of the high explosion and fire risks involved. Moreover, the solvent resistance of the fabric required for pre-impregnation has to be extremely good, because of the prolonged period of contact with solvent.

According to the invention, apparatus for providing impregnated wipes comprises wipe holding means which can be loaded with a batch of wipes; delivery means for delivering fluent material to sequential wipes as they become available from the batch of wipes; a housing or cover for the wipe holding means; means enabling relative movement between the wipe holding means and housing or cover; and means for causing :

(a) fluent material to be delivered to the next available wipe, either during said relative movement or when the latter wipe is under the cover or within the housing, and (b) the wipe to which the material has been delivered to be made accessible to the user.

The fluent material may be a liquid, such as water, solvent, solution of an active substance in water or solvent or even a powder. For the purposes of explanation, it will be assumed that the material is a liquid.

One of the advantages of the invention is that the fluent material or liquid need not be applied to a wipe until the user requires an impregnated wipe.

Preferably, the wipe holding means is designed to hold a stack of pre-cut wipes which can be individually removed. However, it is also possible to provide a batch of wipes in the form of a roll, with individual wipes being removed as required. The wipes may be of various ply thicknesses, depending on user requirements, but they are usually of the same thickness in a given stack.

The means for delivering fluent material to sequential wipes may take various forms. For example, it may apply liquid material in the form of a coating, mist, or spray. Preferably, any such material is applied uniformly to each wipe, in turn. In the case of using absorbent wipes which are stacked one on top of the other, the amount of fluent material supplied, during delivery, is preferably controlled so that only the uppermost wipe is treated or impregnated and substantially no material soaks through into the next adjacent wipe. However, if some minimal amount of material soaks into the second wipe, this would not be unacceptable in most cases. Factors which contribute to the amount of material deposited on each wipe can be carefully controlled to ensure that only each next available wipe is impregnated with the material. These factors include, for example, the speed of relative movement between the wipe holding means and the cover or housing, i.e. where this movement is employed in causing fluent material to be delivered uniformly to the surface of the wipe. For example, the holding means may slide into and out of the housing and thereby transport each next available wipe beneath some form of spray head. Such a spray head extends across the width of the wipe, perpendicular to the direction of sliding movement, to ensure an even distribution of material. However, other factors may include the size of orifices in the spray head (e.g. jet sizes) and the pressure under which the fluent material is supplied. Alternatively, the cover may move over stationary wipe holding means and some form of spray head may be attached to a leading edge of the cover.

Whilst it is preferred to deposit material onto each wipe by spraying, or allowing material to fall, it would also possible to use some form of contact to smear material onto the wipe.

Another advantage of applying fluent material to a wipe immediately before use is that little or no evaporation may occur, especially in the case of solvents. Whilst this is more economic, it is also less hazardous because materials, such as solvents, can be stored independently, so that there is far less risk of fire, explosion, or inhalation.

The delivery means for delivering fluent material may include connecting means, such as a hose and a connector, for connection to an independent supply of fluent material. This enables the material to be supplied in a container, which may be under pressure, that is simply coupled to the delivery system. As such a container need not be specially adapted (apart from withstanding any applied pressure), this greatly reduces the expense and/or difficulties associated with pre-impregnated batch coreless rolls which, when the liquid is flammable, must be stored in a fire-proof and explosion proof-container. In this case, not only is the risk of hazard reduced but a dispensing system can also be constructed more simply and less expensively. In a preferred embodiment of the invention a carrier, such as a trolley, may be provided for a container of material, the other components of the system being also mounted on the trolley for portability.

In the preferred embodiment of the invention, the wipe holding means is in the form of a drawer which is slidably located in the housing, the housing being equipped with the delivery means so that, as the drawer moves into the housing, the fluent material is evenly distributed over the surface of the uppermost wipe in the batch, i.e. as the batch is transported past an outlet of the delivery means. The impregnated wipe is then retained within the housing, whilst the drawer is shut, until it is required by the user. The drawer can then be withdrawn from the housing and moved into a position at which the user can simply extract the uppermost wipe before causing the cycle to be repeated.

In an alternative embodiment of the invention, the fluent material is evenly distributed over the surface of the uppermost wipe in the batch, whilst the drawer moves out of the housing. For example, spraying of the fluent material may start when the drawer begins to open (for example when an operating control is activated) and may stop when the drawer reaches a fully open position. This embodiment may be preferred where the wipe is impregnated with a high volatile solvent (such as an acetone, or a lend of acetone with ethyl acetate), because the user can then remove a wipe, which has been freshly impregnated with the highly volatile solvent when the drawer is opened (i.e. as required by the user).

The system is preferably pneumatically operated, because this is safer when using materials which are inflammable.

Such a pneumatic system may include operating buttons which cause the necessary relative movement to occur to delivery the fluent material to the next available wipe and to make the wipe accessible to the user.

A preferred embodiment of the invention will now be described with reference to the accompanying schematic drawings, in which.

Figure 1:
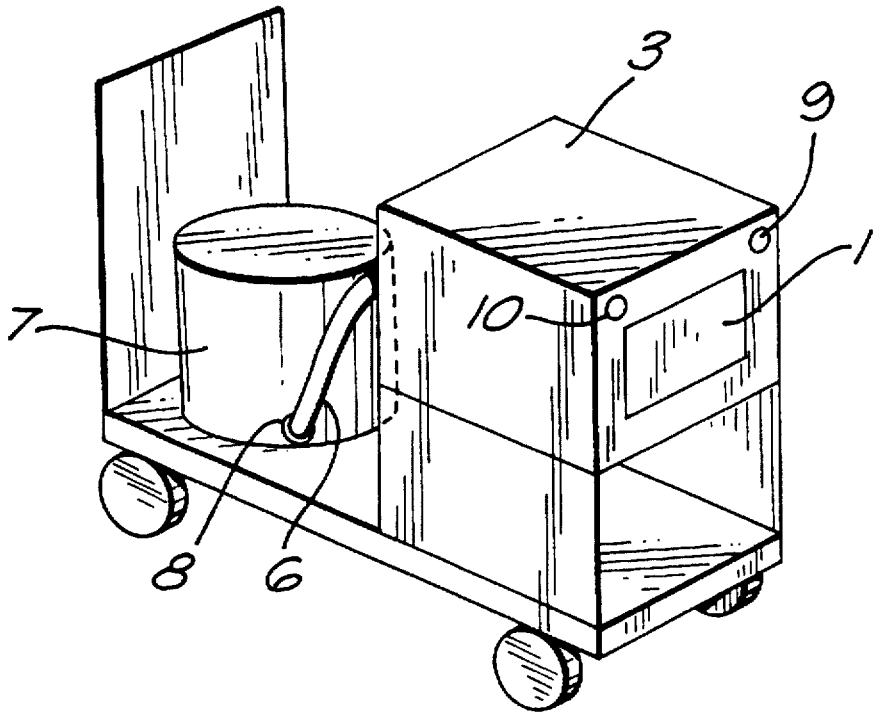
FIG. 1 is a perspective view of a system embodying the invention and shown in a "drawer-closed" position.
Figure 2:
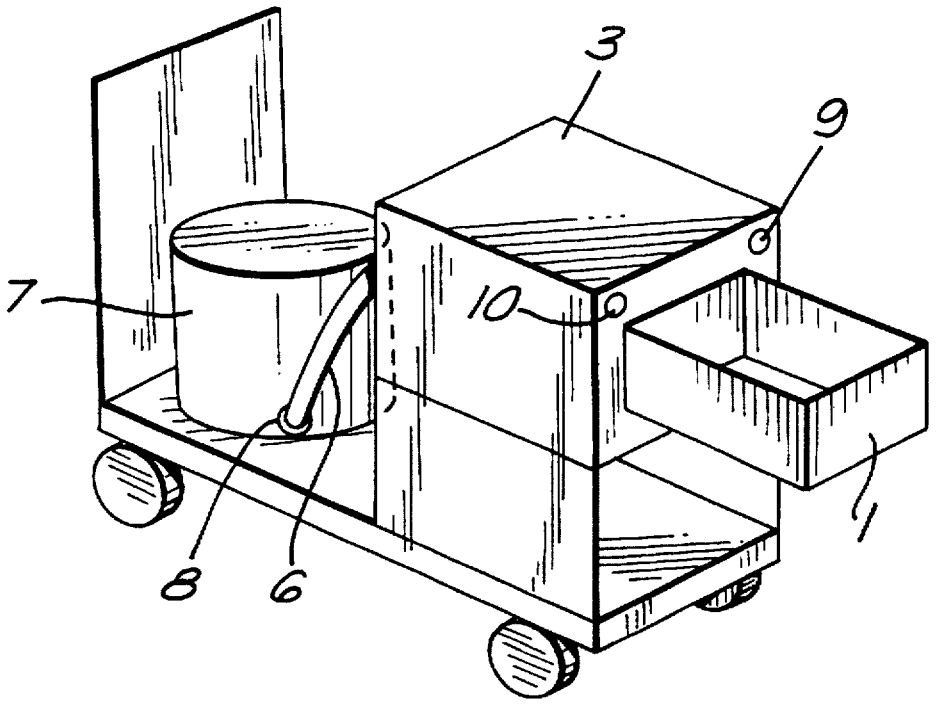
FIG. 2 is a similar view, but showing the system in a "drawer-open" position.
Figure 3:
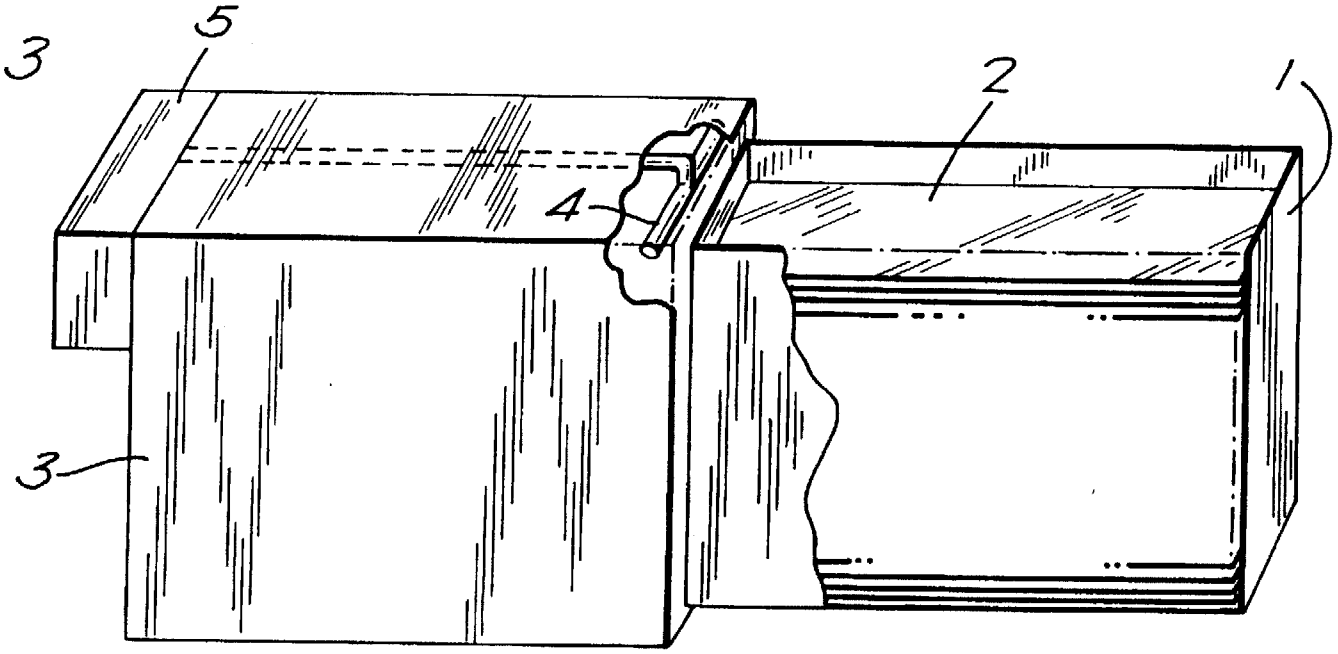
FIG. 3 is a perspective view, partly broken away showing a spray or jet unit in the system for distributing solvent onto the uppermost wipe in a stack of wipes contained in the drawer.
Figure 5:
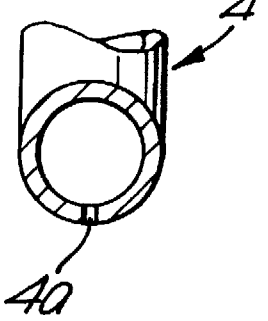
FIGS. 4 and 5 are cross-sections, perpendicular to one another of the spray head.
Figure 4:
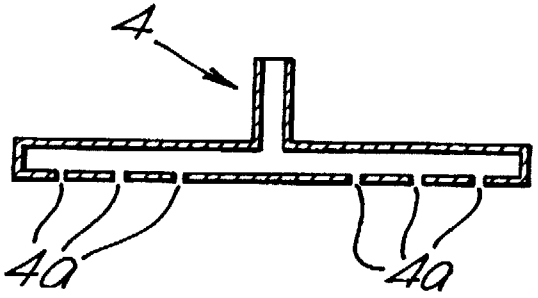
Figure 6A:
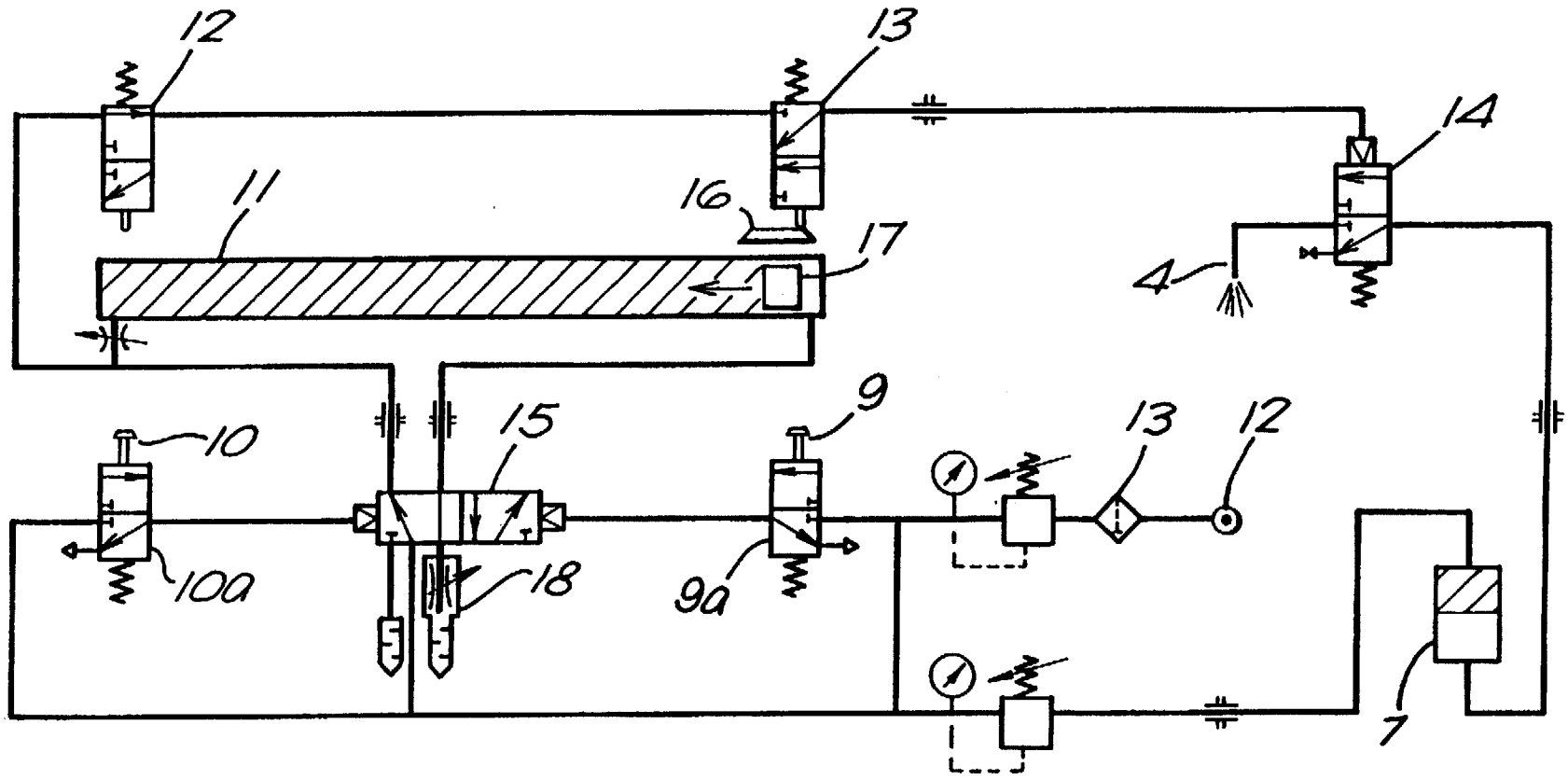
FIGS. 6*a*–6*d* show different operating phases of a pneumatic circuit for controlling the operation of a system.
Figure 6B:
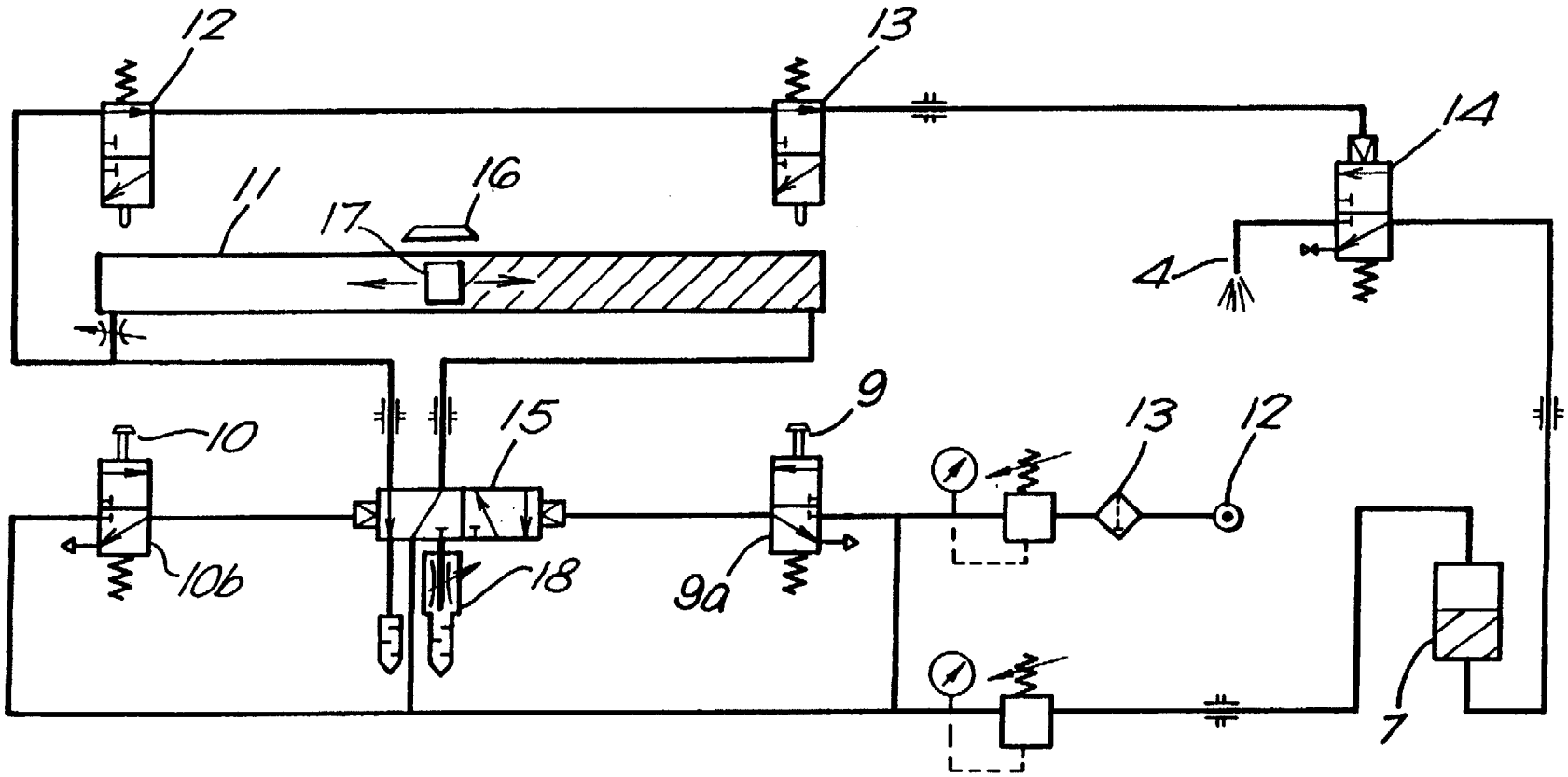
Figure 6C:
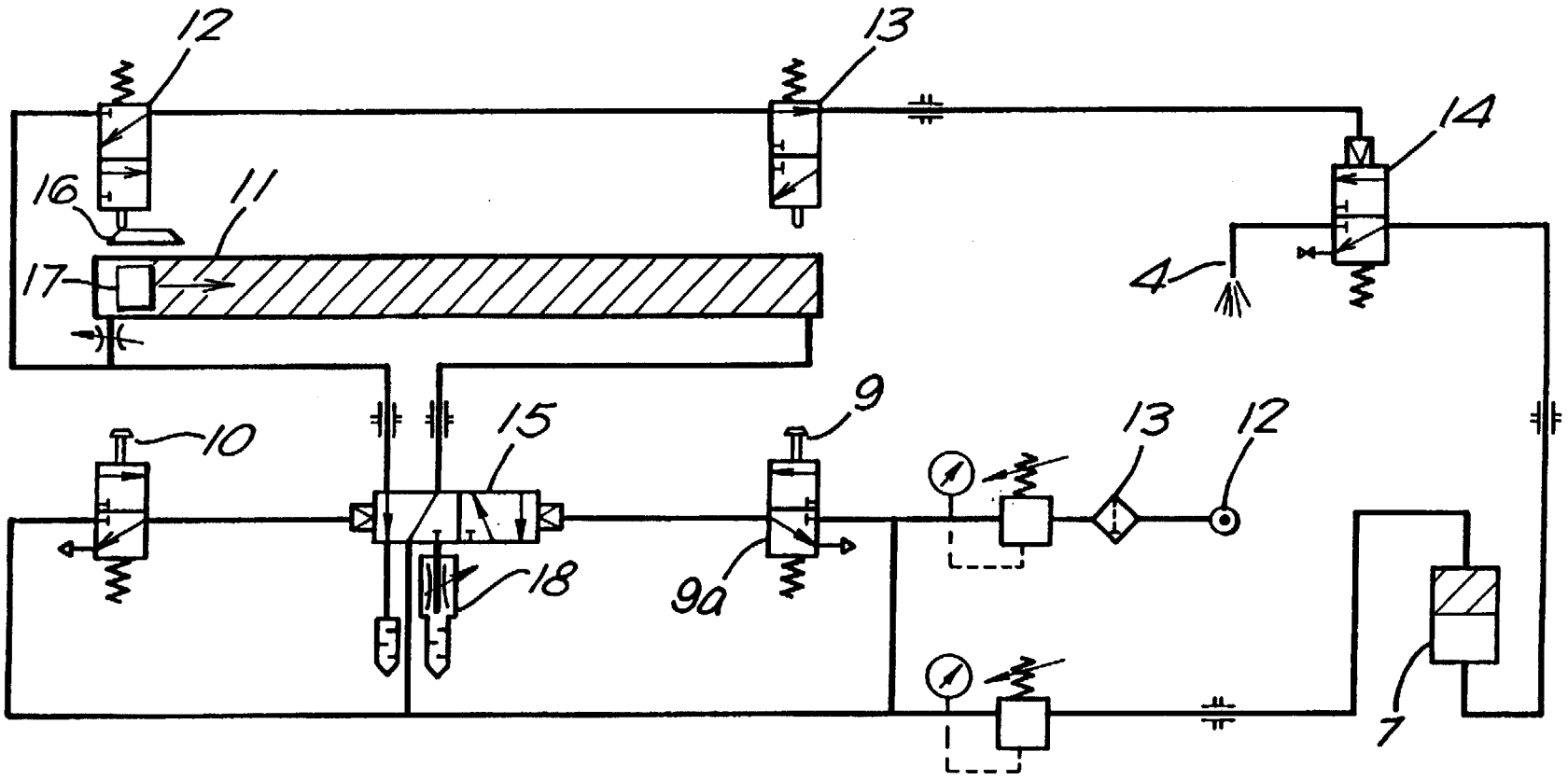
Figure 6D:
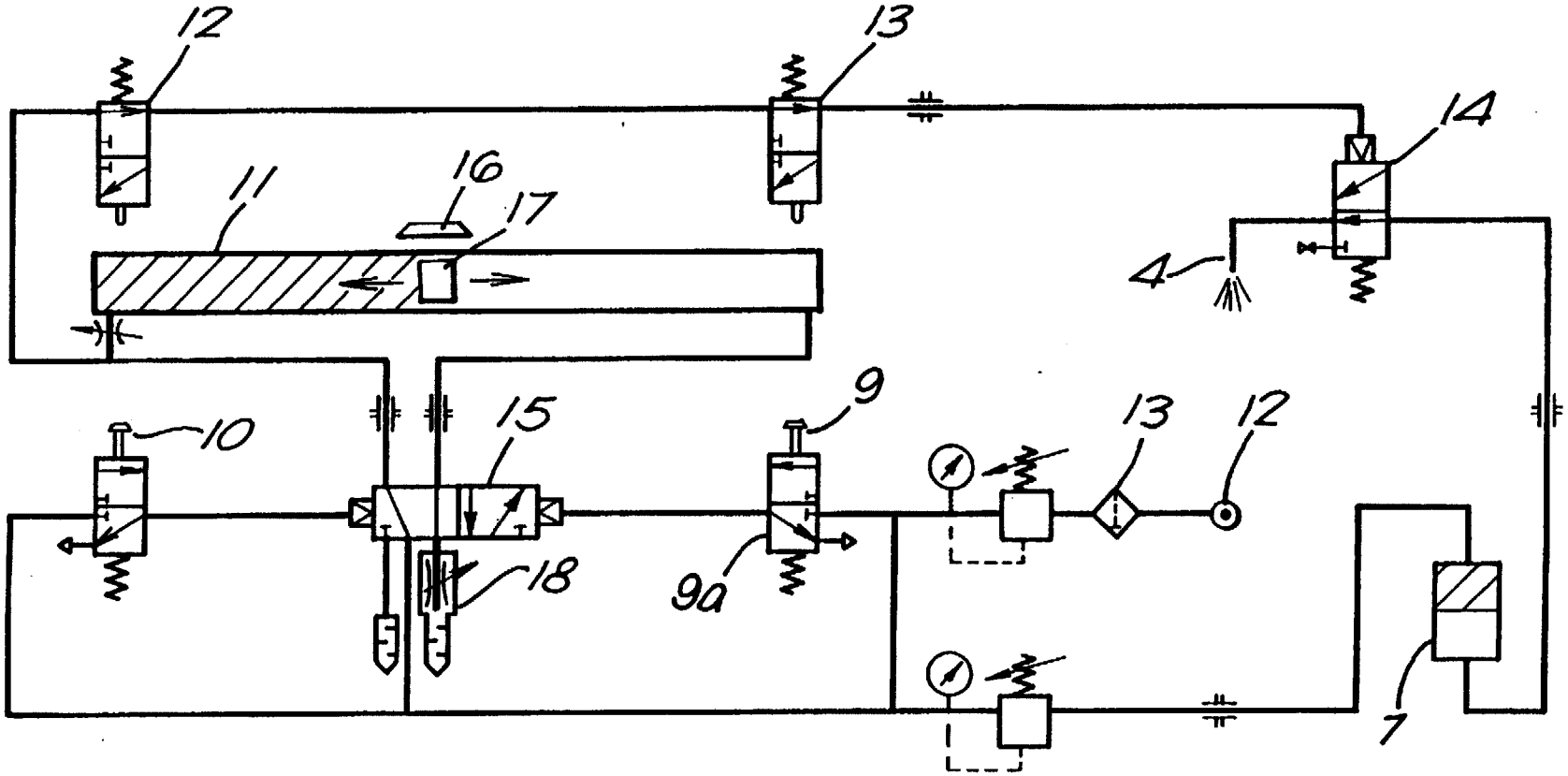
Figure 6E:
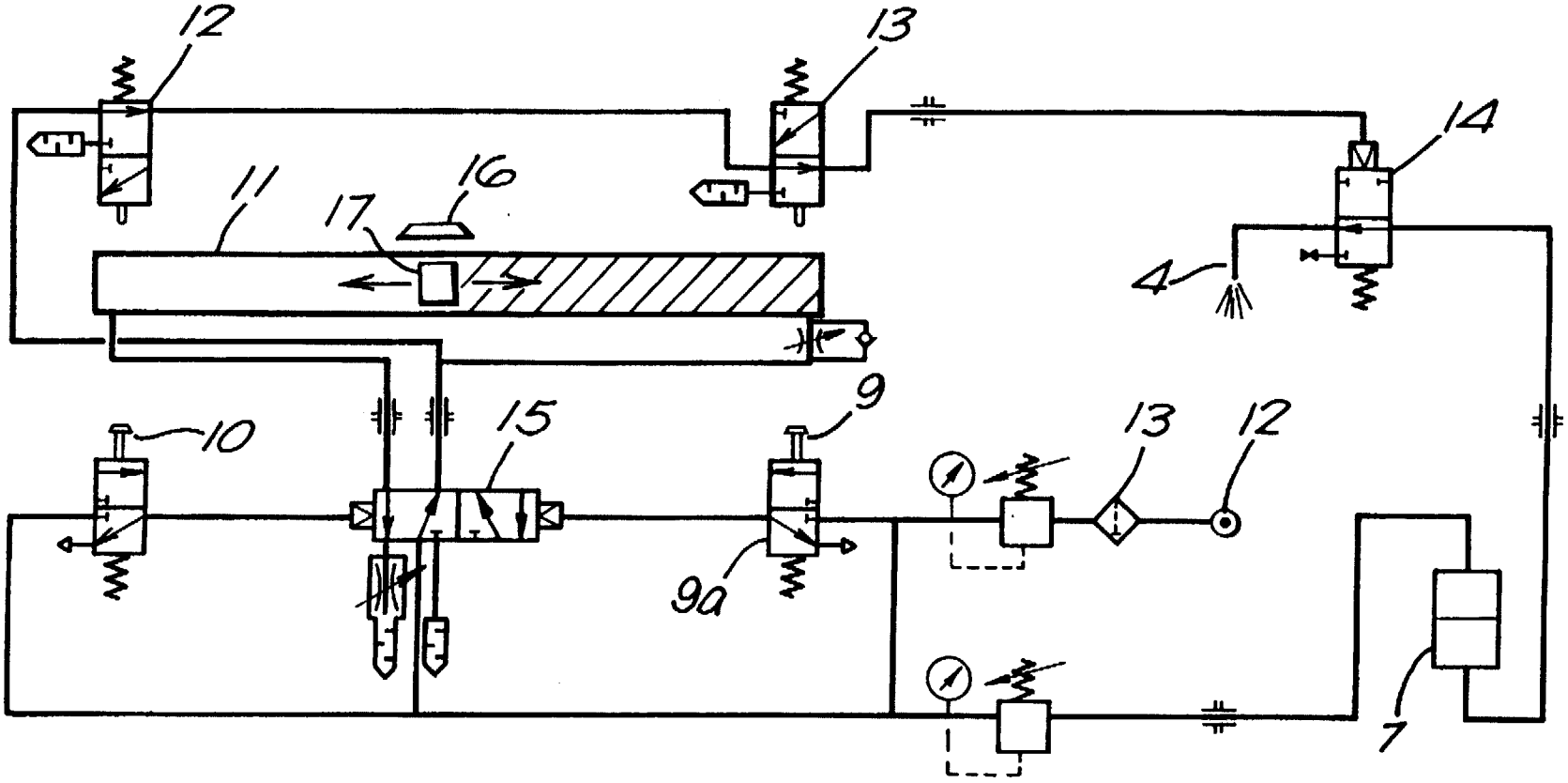

FIGS. 6*e* shows a phase in a modified pneumatic circuit.

Referring to the drawings, a dispensing system for instant solvent wipes includes a drawer 1 for receiving a stack 2 of individual absorbent wipes, and a housing 3 in which the drawer 1 is slidably mounted. The slidable mounting may be of any convenient conventional form, for example, similar to those used in filing cabinets.

The wipes may be of any suitable material. For example, they may be in the form of paper, woven or non-woven fabric, gauze, or the like or any other suitable means for receiving the fluent material. Such means also generally suffers no deleterious effect, in the course of time, after the fluent material has been delivered. For example, it does not dissolve or disintegrate.

Mounted within the housing 2 is a spray head or jet unit 4, which includes a plurality of liquid outlets, such as orifices 4*a*, nozzles, or jets, which are arranged transversely across the direction of movement of the drawer 1. These outlets 4*a* are preferably arranged in a row in a T-shaped tubing assembly as shown in the drawings. Preferably, the outlets are at equally spaced locations extending from one side to the other so that, as the stack of wipes is carried beneath the spray head or jet unit, the material (solvent) is distributed evenly on the upper surface of the uppermost wipe. The amount of material (solvent) delivered is predetermined, for example, by selecting a suitable orifice size and a suitable number of outlets 4*a*. This amount can be changed quickly by simply removing the spray head 4 and substituting another having outlets with a different orifice size, and/or having more or less outlets. Fine adjustment of the amount delivered can be made by controlling the speed at which the drawer moves, for example, by adjusting a restrictor which restricts the air flow from the cylinder when the drawer closes. (Such a restrictor 18 is shown in FIG. 6*d* on the side of the cylinder which is then venting to atmosphere.) Also, the pressure under which solvent is delivered can be adjusted by means of a separate regulator. These adjustments are made so that (preferably) the quantity of solvent deposited on the uppermost wipe is sufficient to treat or impregnate it for use, but not sufficient to cause any appreciable amount of solvent to soak downwardly into the next adjacent wipe in the stack. Whilst the aim is to deliver solvent to the uppermost wipe in the stack, a small amount of downward flow into the next adjacent wipe can be tolerated, in most cases.

Although not illustrated, the outlets may also be arranged in more than one row, depending on the amount of material and spray pattern required for depositing the material on each absorbent wipe.

The spray head 4 is preferably connected to a valve in a pneumatic system (described with reference to FIGS. 6*a*–6*d*) which causes the spray head 4 to be pressurised for spraying while the drawer 1 is closing. The pneumatic system is contained by the housing and a compartment 5. In the preferred embodiments of the invention, the drawer 1 is moved in and out of the housing by a pneumatic piston and cylinder. The mechanical linkage is neither described nor illustrated in detail, but any conventional means may be used to couple drawer movement to the piston (or cylinder), as will be apparent to those skilled in the art. The system is triggered, e.g. by pressing a button, to pressurise the cylinder. This initiates drawer closure.

In one embodiment of the invention, which will be described (by way of example) the spray head 4 then starts to spray material onto the moving surface of the uppermost wipe. This continues until the drawer reaches its closed position, where a proximity switch triggers the system so that the spray head is switched off. Another button can then be pressed to open the drawer, to provide access to the sprayed wipe. This is described in more detail below. In another embodiment of the invention, after initiating drawer opening by pressing a button, the spray head 4 then starts to spray material onto the moving surface of the uppermost wipe and this continues until the drawer reaches its fully open position where a proximity switch triggers the system so that the spray head is switched off. The other button can then be pressed to close the drawer (after removal of the uppermost wipe).

As basically the same equipment is used in both the latter embodiments of the invention, i.e. to spray material onto the uppermost wipe either as the drawer is closed, or as it is opening, no detailed description will be given of the latter usage. Instead, a detailed description will be given of the former usage, because those skilled in the art will understand, by analogy, how the system can be modified to suit a particular requirement. Such modifications may include, for example, operation of the spray head over shorter regions of drawer movement (either opening or closing), and/or over intermittent intervals during drawer movement.

The speed of drawer movement, size of the openings 4*a* and the pressure under which the solvent is supplied are carefully controlled so that just enough solvent is sprayed to impregnate or moisten the uppermost wipe without the solvent (or a significant amount) soaking through the first wipe to the second wipe in the stack.

The preferred system is semi-automatic, but either manual or fully automatic systems could be employed as necessary. The pneumatic system is connected, by tubing 6, to a container of solvent. A suitable connector 8 can be used to couple the container to the system, whereby it can be replaced when empty.

The system, shown mounted on a rollable trolley, is preferably pneumatically operated to reduce fire hazards.

Operating buttons may be provided on the front of the housing for semi-automatic operation. Assuming the container has been filled with solvent and a compressed air supply has been turned on to pressurise the contents of the container, the system may be bled, if necessary, to remove any air. On pressing an "open" or "out" button 9, air cylinder 11 (see FIG. 6) is actuated to open the drawer 1. A stack of individual absorbent wipes is then loaded into the drawer.

After pressing a "close" or "in" button 10, the drawer 1 closes and the jet or spray head 4 is activated to cause solvent to be sprayed onto the uppermost wipe. After the drawer has closed, the "open" button can be pressed again, to cause the drawer to open, thereby enabling a user to remove the top solvent treated wipe for usage.

The user then presses the "close" button to close the drawer again and to repeat the cycle.

The jet or spray head may also be independently turned off when it is only necessary to close the drawer, i.e. when no more solvent wipes are required.

One suitable form of pneumatic circuit will now be described by way of an example of showing how the system can operate.

FIG. 6*a* shows the system at rest where inlet air, supplied to inlet 12, passes through a regulator 13 (set at a pressure of 4 bars) and filter, and is stopped by valves 9*a*, 10*a*, 13 and 14. At this stage, valve 12 is open and valve 13 is closed due to the position of cam 16, which travels with piston 17. The cam 16 operates proximity plungers or buttons shown at the base of valves 12,13. Valve 14 is closed so that no material is supplied to spray head 4. Change-over valve 15 is in the position shown where the "OUT" side of cylinder 11 is pressurised and the "IN" side is vented to atmosphere. The air pressure in the solvent tank 7 is built up via another regulator (not shown). In this rest position, the drawer is closed, but the spray is not activated.

In order to start a cycle, the "out" button 9 is pressed. This causes valve 15 to change-over, as shown in FIG. 6*b*, whereby the "IN" or right-hand side of the cylinder 11 is pressurised, driving piston 17 and causing the drawer, which is linked to piston 17, to start to move out. FIG. 6*b* shows an intermediate, or half-open position. During this phase, the "OUT" side of cylinder 11 is vented and valves 12 and 13 are thus open to atmosphere.

On reaching the drawer open position, valve 12 is closed by cam 16. This is shown in FIG. 6*c*.

The "IN" button 10 can then be pressed, whereby the valve 15 changes over to the position shown in FIG. 6*d*, where pressurised air is supplied to valve 12 and to the "OUT" side of cylinder 11. This causes the piston 17 to return towards its starting position, whereby cam 16 moves away from the proximity button of valve 12, which then opens, allowing pressurised air to flow, through valve 13, to valve 14. Valve 14 then opens and the spray head 4 is supplied with solvent, under pressure, from tank 7 so that solvent is sprayed onto the wipe during drawer closure.

When the drawer is closed, cam 16 trips valve 13 off, so that valve 14 closes, thereby terminating the solvent spray., The cycle can then be repeated.

In an alternative arrangement, not illustrated, the spray head may have outlets distributed over the ceiling of the housing so that the drawer can be fully closed, before the spray head is supplied with solvent. In this case a timer could be used to control the spraying period.

In another arrangement, the system shown in FIGS. 6*a*–6*d* is modified so that valve 12 is connected to the other end of cylinder 11. In this case, when the "OUT" button 9 is pressed, valve 15 changes over to pressurize the "IN" side of cylinder 11 (as before) and it also pressurizes valve 12. As valve 13 is tripped open by cam 16, pressure is supplied to valve 14 and spray head 4 is supplied with solvent. This functional stage is shown in FIG. 6*e*. Subsequently, when the drawer is fully open, cam 16 trips valve 12 off so that valve 14 closes thereby terminating the solvent spray.

Indicator lights may be provided to show each stage of operation and to indicate that a wipe is ready to be removed.

Instead a drawer moving into a housing, the system can include a stationary open box for holding wipes and a moving cover which closes the box. A similar pneumatic system can be used to control cover movement and a spray head attached to the cover.

We claim:

1. Apparatus for providing individual wipes impregnated with a fluent material, said apparatus comprising a housing, a drawer in said housing, said drawer being slidably movable in and out of said housing, a stack of individual wipes in said drawer, with said stack comprising an upper most wipe having an exposed surface, fluent delivery means within said housing adjacent said wipes for applying a fluent material to said exposed surface, and means for operating said fluent delivery means to impregnate said uppermost wipe with fluent material in response to movement of said drawer into said housing.

2. Apparatus for providing individual wipes impregnated with a fluent material, said apparatus comprising a housing, a drawer in said housing, said drawer being slidably movable in and out of said housing, a stack of individual wipes in said drawer, with said stack comprising an uppermost wipe having an exposed surface, fluent delivery means within said housing adjacent said wipes for applying a fluent material to said exposed surface, and means for operating said fluent delivery means to impregnate said uppermost wipe with fluent material in response to movement of said drawer out of said housing.

3. The apparatus of claims 1 or 2 wherein said fluent delivery means applies fluent material to said exposed surface in a uniform manner.

4. The apparatus of claims 1 or 2 wherein said means for operating said fluent delivery means causes a predetermined amount of fluent material to be applied.

5. The apparatus of claim 4 wherein said predetermined amount is sufficient to impregnate only a single wipe.

6. The apparatus of claims 1 or 2 wherein said fluent material is a liquid, and said apparatus additionally comprises a separate container for said liquid.

7. The apparatus of claim 6 wherein said container for said liquid is located externally from said housing.

8. The apparatus of claims 1 or 2 wherein said means for operating said fluent means comprises a valve.

9. The apparatus of claims 1 or 2 additionally comprising pneumatic means for moving said drawer out of said housing.

10. Apparatus for providing individual wipes impregnated with a fluent material, said apparatus comprising a housing, a drawer having an open top, said drawer being slidably movable into and out said housing, a stack of individual wipes in said drawer, with said stacks comprising an uppermost wipe having an exposed upper surface, fluent delivery means within said housing above said drawer for applying a fluent material to said exposed upper surface, and means for operating said fluent delivery means upon sliding movement of said drawer.

* * * * *